US010054309B2

(12) United States Patent
Born et al.

(10) Patent No.: US 10,054,309 B2
(45) Date of Patent: Aug. 21, 2018

(54) DEVICE FOR REGULATING A BURNER SYSTEM

(71) Applicant: Siemens Aktiengesellschaft, Munich (DE)

(72) Inventors: Thomas Born, Karlsruhe (DE); Bernd Schmiederer, Karlsruhe (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 222 days.

(21) Appl. No.: 14/982,171

(22) Filed: Dec. 29, 2015

(65) Prior Publication Data

US 2016/0209026 A1 Jul. 21, 2016

(30) Foreign Application Priority Data

Jan. 19, 2015 (EP) ..... 15151600

(51) Int. Cl.
*F23C 99/00* (2006.01)
*F23N 5/12* (2006.01)

(52) U.S. Cl.
CPC ..... *F23C 99/001* (2013.01); *F23N 5/12* (2013.01); *F23N 5/123* (2013.01)

(58) Field of Classification Search
CPC ..... F23N 5/12
USPC ..... 431/2, 25
See application file for complete search history.

(56) References Cited

U.S. PATENT DOCUMENTS 2,455,350 A * 12/1948 Beam ..... F23N 5/12 250/214 R
3,399,974 A * 9/1968 Spencer ..... G01N 27/626 422/54
3,850,579 A * 11/1974 Dubsky ..... G01N 30/68 422/54

(Continued)

FOREIGN PATENT DOCUMENTS

EP 1750058 A2 2/2007 ..... F23N 5/12
EP 2177830 A1 4/2010 ..... F23D 14/58
EP 2466204 B1 11/2013 ..... F23N 5/12

OTHER PUBLICATIONS

European Search Report, Application No. 15151600.2, 7 pages, dated Jul. 10, 2015.

(Continued)

*Primary Examiner* — Avinash Savani
(74) *Attorney, Agent, or Firm* — Slayden Grubert Beard PLLC

(57) ABSTRACT

A device for regulating a burner system with at least one burner and at least one ionization electrode that lies in a flame of the at least one burner when the burner system is operating. The regulation device is configured to (a) set an air volume flow rate of the burner system, (b) record an ionization current based on the ionization electrode(s), (c) store, in memory, pairs of air volume flow rate of the burner system and ionization current, (d) form a difference between the reciprocal value of a first ionization current for a first air volume flow rate and a reciprocal value of a second ionization current recorded prior to the first ionization current and associated with the first air volume flow rate and (e) calculate the value of a displaced ionization current as the sum of this difference and of the reciprocal value of a further ionization current.

20 Claims, 2 Drawing Sheets

(56) References Cited

U.S. PATENT DOCUMENTS

| | | | | | |
|---|---|---|---|---|---|
| 4,588,372 | A * | 5/1986 | Torborg | F23N 1/025 | 431/12 |
| 5,016,198 | A * | 5/1991 | Schreiber | G01D 3/022 | 702/104 |
| 5,049,063 | A * | 9/1991 | Kishida | F23N 1/022 | 431/25 |
| 5,896,842 | A * | 4/1999 | Abusamra | F02P 5/152 | 123/406.39 |
| 2005/0037301 | A1* | 2/2005 | Lochschmied | F23N 1/022 | 431/6 |
| 2012/0138809 | A1* | 6/2012 | Mindermann | F23N 5/082 | 250/372 |
| 2012/0156628 | A1 | 6/2012 | Lochschmied et al. | 431/78 | |
| 2012/0276487 | A1* | 11/2012 | Hangauer | F23N 5/123 | 431/75 |

OTHER PUBLICATIONS

European Office Action, Application No. 15151600.2, 6 pages, dated Apr. 25, 2018.

* cited by examiner

DEVICE FOR REGULATING A BURNER SYSTEM

CROSS-REFERENCE TO RELATED APPLICATIONS

This application claims priority to EP Application No. 15151600.2 filed Jan. 19, 2015, the contents of which are hereby incorporated by reference in their entirety.

TECHNICAL FIELD

The present disclosure relates to regulating curves, as are used for example in conjunction with ionization electrodes in burner systems, for example in gas burners. In particular the present disclosure relates to the correction of such regulating curves, taking into account the ageing and/or drift of a sensor signal.

BACKGROUND

In burner systems the air/fuel ratio during combustion is able to be established on the basis of an ionization current by an ionization electrode. First of all an AC voltage is applied to the ionization electrode. Because of the rectifier effect of a flame, an ionization current flows as a DC current in only one direction.

In regulating curves for ionization electrodes the ionization current detected at the ionization electrode is plotted against the rotational speed of the fan of a gas burner. The ionization current is typically measured in microamperes. The rotational speed of the fan of a gas burner is typically measured in revolutions per minute. The rotational speed of the fan of a gas burner is at the same time a measure for the air volume flow rate and for the power of the burner system, i.e. for a quantity of heat per unit of time.

Entered along such a regulating curve is a plurality of test points. Initially these test points can be recorded under laboratory conditions as part of testing. The recorded values are stored and taken into account in (electronic) control.

Ionization electrodes are subject to ageing during operation. This ageing is caused by deposits and/or accumulation of layers during the operation of a burner system. In particular a layer of oxide, the thickness of which changes over the hours of operation, can form on the surface of an ionization electrode. As a result of the ageing of an ionization electrode, a drift of the ionization current occurs. Thus a regulating curve recorded under laboratory conditions requires correction from time to time, at the latest after 1000 to 3000 hours of operation.

A regulation device with correction of the regulating curve of an ionization electrode is disclosed in EP2466204B1. The regulating curve is corrected here in three steps. First of all the regulation device performs regulation operation. Subsequently the regulation device controls or regulates the actuators of the burner system to a changed supply ratio. In particular the speed of the fan of a burner system is changed. By controlling the actuators the regulation device sets an air volume flow rate of the burner system.

The changed supply ratio in this case lies above the stoichiometric value of the air-fuel ratio of 1. Preferably the air-fuel ratio is reduced by 0.1 or by 0.06 to values greater than or equal to 1.05. In a third step a new required value is computed from the ionization signal detected in such cases and from stored data.

However the correction of the regulating curve requires that the heat created during the duration of the tests can also be dissipated to consumers, such as heating or process water. Otherwise the amount of heat created during the test is higher than the amount of heat dissipated. As a result the temperature in the system increases and the temperature controller of the system switches the burner off. The test on a specific air volume flow rate cannot be completed in this case.

This problem becomes even more acute because a little time is needed during a test run to obtain stable values. Another complicating factor is that the duration of a test run can generally not just be shortened arbitrarily.

SUMMARY

One embodiment provides a device for regulating a burner system with at least one burner, and with at least one ionization electrode, which is disposed so that, when the burner system is operating, it lies in the area of a flame of the at least one burner, wherein the regulation device is embodied, on the basis of the at least one ionization electrode, to record an ionization current, wherein the regulation device is embodied to set an air volume flow rate of the burner system, taking into account the ionization current, wherein the regulation device comprises a memory and is embodied to store pairs consisting of air volume flow rate of the burner system and ionization current, wherein the regulation device is embodied to form a difference between the reciprocal value of a first ionization current and a first air volume flow rate and a reciprocal value of a second ionization current, which was recorded at a point in time before the first ionization current and belongs to the first air volume flow rate or essentially belongs to the first air volume flow rate, wherein the regulation device is embodied, as the sum of this difference and of the reciprocal value of a further ionization current, to calculate the reciprocal value and the value of a displaced ionization current, wherein the further ionization current and the displaced ionization current belong to a second air volume flow rate of the burner system, which is different from the first air volume flow rate of the burner system, wherein the regulation device is embodied to filter the reciprocal value or the value of the displaced ionization current using a filter constant on the reciprocal value or value of a historical ionization current, which was recorded at a point in time before first ionization current and belongs to the second air volume flow rate or essentially belongs to the second air volume flow rate, so that, as result of the filtering, a filtered ionization current and its reciprocal value are calculated.

In a further embodiment, the regulation device is additionally embodied to calculate a second difference from a reciprocal value of the filtered ionization current and from a reciprocal value of the further ionization current.

In a further embodiment, the regulation device is additionally embodied to add the second difference to the reciprocal value of a third ionization current and to obtain from said addition a displaced third ionization current, wherein the third ionization current was recorded at a point in time before first ionization current and belongs to the second air volume flow rate of the burner system.

In a further embodiment, the regulation device is additionally embodied, to join together pairs consisting of air volume flow rate of the burner system and ionization current into a regulating curve and to store them.

In a further embodiment, the regulation device is additionally embodied, to compute and/or to store the displaced third ionization current as part of a corrected regulating curve and/or to compute and/or to store from this ionization current, the correction, especially the deviation, from the original regulating curve.

In a further embodiment, the second ionization current was recorded under laboratory conditions at a new or little-aged ionization electrode.

In a further embodiment, the further ionization current was recorded under laboratory conditions at a new or little-aged ionization electrode.

In a further embodiment, the historical ionization current was recorded at a point in time after the second ionization current.

In a further embodiment, the value or the reciprocal value of the displaced ionization current are filtered on the value or reciprocal value of a historical ionization current, in that the value or reciprocal value of the displaced ionization current are reduced by a percentage and the value or the reciprocal value of the historical ionization current are increased by the same percentage.

In a further embodiment, the regulation device is embodied, on the basis of the at least one ionization electrode, to record an ionization current and the recording of the ionization current comprises a number of individual measurements of ionization currents.

In a further embodiment, the regulation device is embodied, during operation, starting from the current air volume flow rate of the burner system, to select a best fitting test point of the regulating curve and to record at this test point a pair consisting of ionization current and air volume flow rate and to defer the recording of pairs consisting of ionization current and air volume flow rate to other test points or the regulating curve.

In a further embodiment, the regulation device is embodied to form a difference between the reciprocal value of a first ionization current for a first air volume flow rate and a reciprocal value of a second ionization current, which was recorded at a point in time before the first ionization current, and belongs to the first air volume flow rate or essentially belongs to the first air volume flow rate, and wherein the formation of the difference only occurs for the first time after an hour or after two hours or after five hours or after ten hours or after 20 hours or after one day or after two days or after 5 days or after 10 or after 20 days.

In a further embodiment, the regulation device is embodied, on the basis of the at least one ionization electrode, to repeatedly record ionization currents, and the regulation device is embodied to repeatedly form a difference between the reciprocal value of a first ionization current for a first air volume flow rate and a reciprocal value of a second ionization current which was recorded at a point in time before the first ionization current, and belongs to the first air volume flow rate or essentially belongs to the first air volume flow rate, and wherein the time intervals between the formation of the differences depend on the differences between the ionization currents recorded in each case.

Another embodiment provides a method for regulating a burner system with at least one burner, with at least one memory, with at least one ionization electrode, which is disposed such that, during operation of the burner system, it lies in the area of a flame of the at least one burner, the method comprising the steps of recording of an ionization current on the basis of the at least one ionization electrode, setting an air volume flow rate of the burner system, taking into account the ionization current, storage of pairs consisting of air volume flow rate of the burner system and ionization current, forming a difference between the reciprocal value of a first ionization current for a first air volume flow rate and a reciprocal value of a second ionization current, which was recorded at a point in time before the first ionization current, and belongs to the first air volume flow rate or essentially belongs to the first air volume flow rate, calculating the reciprocal value and the value of a displaced ionization current as the sum of this difference and the reciprocal value of a further ionization current, wherein the further ionization current and the displaced ionization current belong to a second air volume flow rate of the burner system which is different from the first air volume flow rate of the burner system, and filtering of the reciprocal value or of the value of the displaced ionization current, using a filter constant on the reciprocal value or value of a historical ionization current which was recorded at a point in time before the first ionization current and belongs to the second air volume flow rate or essentially belongs to the second air volume flow rate, so that, as a result of the filtering, a filtered ionization current and its reciprocal value are calculated.

In a further embodiment, the method additionally includes the step of calculating a second difference from a reciprocal value of the filtered ionization current and from a reciprocal value of the further ionization current.

BRIEF DESCRIPTION OF THE DRAWINGS

Example embodiments of the invention are described below with reference to figures, in which.

DETAILED DESCRIPTION

Embodiments of the present disclosure provide an improved correction of the regulating curve of an ionization electrode.

The present disclosure is based on the knowledge that burner conditions, and thus any corrections made to a regulating curve, change gradually during operation. In particular the conditions and, as a consequence, the corrections falling due along the regulating curves, generally do not change abruptly. This makes possible an estimation as to how a correction at a test point affects neighboring values.

Such knowledge makes possible the correction of a regulating curve during the operation of a burner system and for any given air volume flow rates. The said knowledge likewise makes possible the correction of a regulating curve in a calibration mode or maintenance mode of a burner system. To this end, in a first step, a number of test points are recorded, i.e. ionization currents plotted against fan speeds or air volume flow rates of the burner system. The result achieved by this is that at least one test point lies close to the air volume flow rate currently needed. Should a test run not be possible at an existing test point, first of all the correction established for a neighboring test point is calculated into the correction of the existing test point. Thus the existing test point corrected in this way is adapted to neighboring test points.

Figure 1:
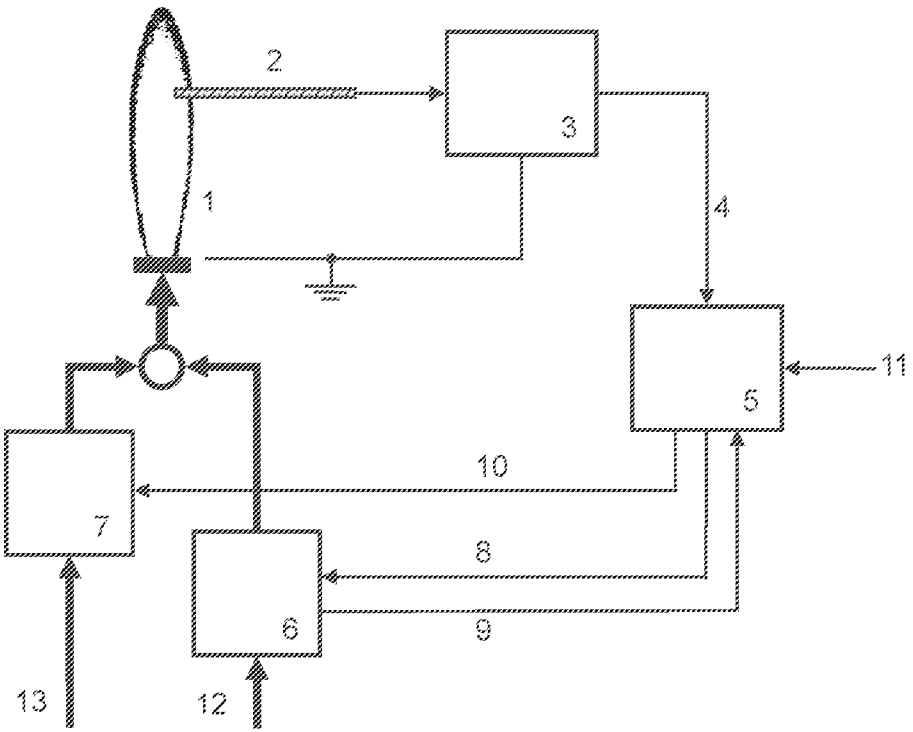
FIG. 1 schematically shows a burner system with a regulation device that is regulated based on an ionization signal, according to an example embodiment.

FIG. 1 schematically shows a burner system, preferably a gas burner, with an inventive regulation device and/or with the inventive method. In normal operation the regulation operates as fuel-air compound regulation. A burner creates a flame (1). An ionization electrode (2) detects an ionization current. An AC current ranging from 110 V . . . 240 V is typically present at the ionization electrode (2). The ionization current detected by the ionization electrode (2) means that an AC voltage applied to the ionization electrode (2) overlays a DC voltage. This produces a direct current. This direct current rises with increasing ionization of the gas in the flame area. The direct current falls on the other hand with an increasing excess of air of the combustion. For further processing of the signal of the ionization electrode it is usual to use a lowpass, so that the ionization current arises from the filtered ionization signal (4). The DC voltage occurring results in a direct current, which typically lies in the area of less than 150 microamperes and frequently lies far below this value.

A device for separation of direct current and alternating current of an ionization electrode is shown for example in EP1154203B1, FIG. 1, and is explained, inter alia, in section 12 of the description. Reference is made here to the relevant parts of the disclosure of EP1154203B1.

Ionization electrodes (2), as are used here, are commercially available. KANTHAL®, e.g. APM® or A-1® is frequently used as material of the ionization electrodes (2). Electrodes made of Nikrothal® are also considered by the person skilled in the art.

The ionization current is amplified by a flame amplifier (3). The flame amplifier (3) also closes the electric circuit by connecting the flame amplifier (3) to the chassis electrode of the burner. The ionization signal (4) processed by the flame amplifier (3) is forwarded to a setting device (5). In normal operation the setting device (5) uses the ionization signal (4) as an input signal for a regulation. The ionization signal (4) is preferably an analog electrical signal. As an alternative it (4) can be embodied as a digital signal or as a digital variable of two software module units.

In operation the setting device (5) reacts to an external request signal (11), which predetermines a heat power. In addition the regulation can be switched on and switched off on the basis of the request signal (11). A quantity of heat and an air volume flow rate connected therewith can be requested from a superordinate temperature regulation circuit not shown in FIG. 1. Furthermore such a specification can be predetermined directly by an external consumer and/or manually, by means of a potentiometer, for example.

It is usual to map the request signal (11) onto one of the two actuators (6, 7) with the aid of data stored in the setting device (5). In a preferred embodiment the request signal (11) is mapped onto required speed values for a fan as first actuator (6).

Subsequently the required speed values are compared with a speed signal (9) returned by a fan (6). A speed regulator integrated into the setting device (5) controls the fan (6) via a first setting signal (8) to a required amount of air (12) to be conveyed in accordance with the request signal (11). In a specific embodiment the setting device (5) includes a rotational speed regulation, especially a rotational speed regulation according to proportional, integral and/or derivative components, and forwards a setting signal to the fan (6). According to a further embodiment the request signal (11) can be mapped directly onto the first setting signal (8) of the fan (6). The mapping of the request signal (11) to a fuel valve as a first performance-managing actuator is also possible.

A second actuator (7), preferably a fuel valve, adjusts the air-fuel ratio via the supply of fuel (13). To this end the setting device (5) maps the predetermined request signal (11), i.e. the speed response signal (9), to a required value of the ionization signal (4). On the basis of the difference between ionization signal (4) and required value of the ionization signal (4), the fuel valve (7) is regulated via a regulation unit contained in the setting device. In this way a change of the ionization signal (4) via a second setting signal (10) causes a change in the setting of the fuel valve (7). Thus the throughflow of fuel (13) is changed. The regulation circuit is closed, by, for a given quantity of air, a change of fuel amount causing a change of ionization current through the flame (1) and through the ionization electrode (2). Connected therewith is a change of the ionization signal (4) until such time as its actual value is again equal to the predetermined required value.

Figure 2:
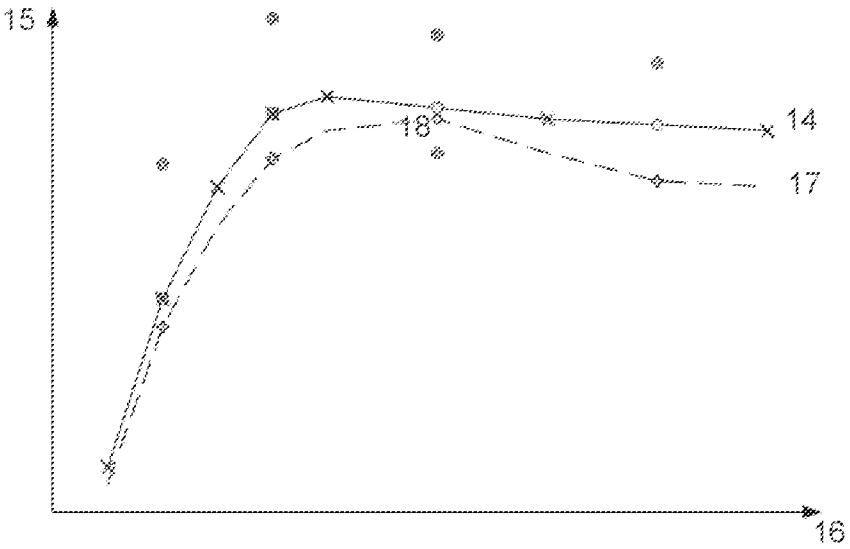
FIG. 2 shows a regulating curve recorded under laboratory conditions and a regulating curve deviating therefrom of an aged ionization electrode with incomplete correction.

FIG. 2 shows a regulating curve (14) as a solid curve. In FIG. 2 the ionization current in microamperes (15) is plotted against the air volume flow rate (16). According to a preferred embodiment the air volume flow rate (16) corresponds to the rotational speed of the fan (6). Such a regulating curve is used by the setting device (5) to set the air-fuel ratio for different request signals (11), taking in account the ionization signal (4).

In other words the regulation device is embodied to set an air volume flow rate (16) of the burner system, taking into account the ionization current (15).

Current burner systems in the sense of this disclosure have powers ranging from a few 10 s of kW up to 100 kW and beyond and the associated air volume flow rates. Normal speeds of the fan range from a few 1000 to 10000 revolutions per minute.

FIG. 2 shows the ionization current (15) for different air volume flow rates (16). The different values of the ionization current (15) for different air volume flow rates (16) are first of all recorded in the laboratory (under test conditions). From these the regulating curve (14) is produced. In FIG. 2 recorded pairs of values consisting of ionization current and air volume flow rate are connected on the basis of straight, solid lines, to form a regulating curve. The pairs of values are support points of the regulating curve and are marked by crosses X in FIG. 2.

The recording of the support points of a regulating curve preferably takes place in the laboratory with a new and/or little-aged ionization electrode (2).

The totality of these support points forms a regulating curve, as shown in FIG. 2. To this end the regulation device is embodied to join the support points together into a regulating curve. According to a preferred embodiment the joining together into a regulating curve also includes the interpolation disclosed below.

Accordingly the regulation device comprises a memory and is embodied for storing pairs consisting of air volume flow rate (16) of the burner system and ionization current (15). The memory can for example involve random access memory (RAM), flash memory, EPROM memory, EEPROM memory, memory registers, one or more hard disks, one or more diskettes, other optical drives or any computer-readable medium. This list is exemplary only. In a preferred embodiment the memory of the regulation device is non-volatile.

According to FIG. 2 there is linear interpolation between the recorded values. In a further embodiment there is quadratic interpolation between the recorded values, i.e. as well as a linear term, a quadratic term and/or a higher-order term is also taken into account. According to a further embodiment there is interpolation between the recorded values on the basis of (cubic) splines.

In general, in addition to the recorded values of the ionization current (15), the interpolation creates further values of the ionization current (15). The further values of the ionization current lie between the recorded values. They also lie between the correspondingly set air volume flow rates (16) of the burner system. The ionization current for the air volume flow rate between the recorded values is produced from the interpolation.

Like the support points of the regulating curve, the test points are likewise established in the laboratory with a new and/or little-aged ionization electrode. This is done with the aid of the test sequence as disclosed in EP2466204B1. Of these test points, the $I_{C0}$ values are shown in FIG. 2 as circles on the regulating curve (14). The $I_{B0}$ values are shown as circles above the regulating curve (14). $I_{C0}$ value and $I_{B0}$ value of a test point lie at the same (or essentially the same) fan speed or at the same (or essentially the same) air volume flow rate. The $I_{C0}$ values are produced from the regulating curve as a result of the selected air volume flow rates for the test points. They can either be identical to a support point or can be computed through interpolation. The $I_{B0}$ values are produced as a result of the selected λ change of the air-fuel ratio at the respective test point.

It is further guaranteed in the laboratory that a requested amount of heat or air volume flow rate (16) is also discharged. Thus the case in which the temperature in the system rises (too quickly or too far) is excluded in the laboratory, because the burner, for the duration of test runs (for setting the fan speeds, the fan speed spacing and establishing the $I_{B0}$ value per test point) creates more heat than can be dissipated. Thus it is possible, under laboratory conditions, to establish all (above-mentioned) values for the test points.

According to a specific embodiment 8, 16, 32 or 64 support points for the regulating curve are recorded in the laboratory. According to a further embodiment 5, 10, 15, 20 or 25 test points are recorded along the regulating curve (14) under laboratory conditions. In the event of the regulating curve points (support points) not coinciding with the test points, interpolation is carried out in accordance with one of the methods given above between the recorded support points of the regulating curve, in order to obtain the $I_{C0}$ values at the test points.

The ionization electrode (2) is typically subject to ageing during operation. The characteristics of the ionization electrode (2) change as a result of the ageing. In other words, the regulating curve of an aged ionization electrode (2) deviates from that (14) of a new ionization electrode (2).

FIG. 2 shows a deviating regulating curve (17) as a dashed-line curve. The deviating regulating curve (17) takes account of the ageing of the ionization electrode (2). The points of this regulating curve (17) indicated in the form of crosses are the ionization current values at the test points corrected as a result of the tests.

FIG. 2 shows a special test point (18) in addition to the cross-shaped test points. Test point (18) involves a test point at which at least one test run must have been aborted (or could even not be started at all). Therefore the ionization current of this test point (18) has been recorded at a point in time before the ionization currents of the other test points of the dashed-line regulating curve (17).

In practice it is entirely possible for a number of test sequences to have failed at the test point (18). This can occur for example if, at the time of one or more tests, the required amount of heat or the required air volume flow rate (16) is not discharged. The temperature in the system rises in such a case, as described above, and the test run is aborted.

The dashed-line regulating curve (17) deviates upwards in the area of the test point (18). Thus the dashed-line regulating curve (17) and the regulating curve (14) recorded in the laboratory are closer to each other in the area of the test point (18) than they would otherwise be. It can be assumed from this that the regulating curve (17) distorted by that test point (18) does not optimally characterize the aged ionization electrode (2).

First of all the obviously erroneous test point (18) can now be corrected, based on the assumption that neighboring test points change in a similar way. At a test point of the regulating curve, let $I_{B0}$ be the recorded ionization current during a test run under laboratory conditions and $I_{B1}$ be the recorded ionization current during a first test run after a few hours operation. According to EP2466204B1 the ionization currents $I_{B0}$ and $I_{B1}$ correspond to an enriched mixture compared to the regulating curve, meaning that there is more fuel (13), especially more gas, and less air (12) present. A similar situation can be reached for example by more fuel (13) being supplied at a constant fan speed.

Now let the test run k have failed at the erroneous test point (18), so that no ionization current $I_{Bk}$ is present. In addition, at the neighboring point of the test points (18), let the ionization current $I_{neighborBk}$ of the kth test run and the corresponding laboratory value $I_{neighborB0}$ be known. The ionization current $I_{Bk}$ is now calculated or estimated from the ionization currents $I_{neighborBk}$ and $I_{neighborB0}$ of the neighboring test points and is called $I_{Bk\uparrow}$ below:

$$\frac{1}{I_{Bk\uparrow}} = \frac{1}{I_{neighborBk}} - \frac{1}{I_{neighborB0}} + \frac{1}{I_{B0}}$$

The estimation is based on the assumption that neighboring test points are (approximately) displaced to the same extent. This assumption is not always a good approximation. This is especially the case if the test value differs greatly from one test run to the next.

The test at a test point estimated through a neighbor (as above e.g. test point (18)) is basically rectified as soon as the burner power or the air volume flow rate matches.

In other words, the disclosed regulation device is embodied to form a difference between the reciprocal value of a first ionization current $I_{neighborBk}$ for a first air volume flow rate and a reciprocal value of a second ionization current $I_{neighborB0}$, which has been recorded at a point in time before the first ionization current $I_{neighborBk}$ and belongs to the first air volume flow rate or essentially belongs to the first air volume flow rate.

Let $I_{neighborB0}$ have been recorded at a point in time before first ionization current $I_{neighborBk}$, in that $I_{neighborB0}$ was recorded for example during a test run under laboratory conditions. Test runs under laboratory conditions typically take place as type tests/setting (=required value/parameter establishment) and/or routine tests and/or as factory tests during the development or during the manufacturing of a device.

The disclosed regulation device is further embodied, as the sum of this difference and of the reciprocal value of a further ionization current $I_{B0}$, to calculate the reciprocal value and the value of a displaced ionization current $I_{Bk\uparrow}$, wherein the further ionization current and the displaced ionization current belong to a second air volume flow rate of the burner system which is different from the first air volume flow rate of the burner system.

In order not to make the correction solely on the basis of this estimation and since $I_{Bk\uparrow}$ will not be identical under all environmental conditions with a real measured $I_{BK}$, $I_{Bk\uparrow}$ is filtered with the filter constant e on the ionization current $I_{B(k-1)}$ of a preceding test run. A value for the filtered ionization current $I_{Bk'}$ is thus obtained.

$$I_{BK'}=I_{B(k-1)}\cdot e+I_{BK\uparrow}\cdot(1-e)$$

In this equation the index k relates to the current test run. The ionization currents and air volume flow rates with the indices 1 to k−1 relate to test runs previously carried out or to the test values computed by filtering, i.e. to historical tests at this test point. Depending on the embodiment, individual values of these historical test values or all historical test values are stored in the regulation device.

In this case the value of the filter constant e can assume values between 0 and 1, preferably between 0.2 and 0.8, further preferably between 0.35 and 0.65 or 0.5 to 0.9. The fitting is done at a test point with the same or with essentially the same air volume flow rate (16) of the burner system.

The person skilled in the art readily recognizes that the aforementioned filtering can also be carried out in a similar manner on the basis of reciprocal values and on the basis of a filter constant e', i.e. according to $$\frac{1}{I_{Bk'}}=\frac{1}{I_{B(k-1)}}\cdot e'+\frac{1}{I_{Bk\uparrow}}\cdot(1-e')$$

The filter constants e and e' can be different from one another.

In other words the regulation device is embodied to filter the reciprocal value or the value of the displaced ionization current $I_{Bk\uparrow}$ using a filter constant e, e' on the reciprocal value or value of a historical ionization current $IB_{(k-1)}$, which was recorded at a point in time before the first ionization current $I_{neighborBk}$ and which belongs to the second air volume flow rate or essentially belongs to the second air volume flow rate, so that as a result of the filtering, a filtered ionization current $I_{Bk}$ and its reciprocal value are computed.

Let $I_{B(k-1)}$ have been recorded at a time before the first ionization current $I_{neighborBk}$ in that $I_{B(k-1)}$ has been recorded for example during the test run in operation with the index k−1. The test run in operation with the index k−1 in this case precedes the test run in operation with the index k. Typical time intervals between consecutive test runs lie in the range of a few 10 s of hours to a few 100 hours. But just a few hours or a few thousand hours can also lie between consecutive test runs.

Each of these filterings hides a Markov assumption, according to which a filtered ionization current $I_{Bk}$ of a test point depends on the ionization current $I_{B(k-1)}$ of its immediately preceding test point. According to a further embodiment the filtered ionization current $I_{BK'}$ of a test point depends on ionization currents $I_{B(k-1)}$ and $I_{B(k-2)}$ of two preceding test points:

$$I_{Bk'}=I_{B(k-1)}\cdot e+I_{B(k-2)}\cdot f+I_{Bk\uparrow}\cdot(1-e-f)$$

The same applies for the filtering on the basis of reciprocal ionization currents. The value of the filter constant f varies, as does the value of the filter constant e, between 0 and 1, preferably between 0.2 and 0.8, further preferably between 0.35 and 0.65 or between 0.5 and 0.9. The filter constants e and f can be the same or different, depending on the embodiment. The person skilled in the art readily recognizes that the filtering of ionization currents on the basis of preceding test points can also relate to more than two ionization currents of preceding test points.

From the computed test value $I_{Bk'}$ the ionization current of the regulating curve is finally corrected in accordance with the method disclosed in EP2466204B1, for example in FIG. 2 the point (18). The method disclosed in EP2466204B1 is based on the knowledge that ionization currents can be corrected like electrical (error) resistances. The corrected ionization current $I_{Ck'}$ of the regulating curve is therefore calculated from the reciprocal ionization currents $1/I_{Bk'}$, $1/I_{B0}$ of (precisely) this test point and from the reciprocal ionization current $1/I_{C0}$ (of the original regulating curve and established at this point under laboratory conditions) in accordance with $$\frac{1}{I_{Ck'}}=\frac{1}{I_{Bk'}}-\frac{1}{I_{B0}}+\frac{1}{I_{C0}}$$

In other words the regulation device is embodied to calculate a second difference from a reciprocal value of the filtered ionization current $I_{Bk'}$ and from the reciprocal value of the ionization current $I_{B0}$.

The regulation device is additionally embodied to add this second difference to the reciprocal value of a third ionization current IC0 and to obtain a displaced third ionization current $I_{Ck}$ from this, wherein the third ionization current $I_{C0}$ was recorded at a point in time before the first ionization current $I_{neighborBk}$ and belongs to the air volume flow rate of the burner system.

Let $I_{C0}$ be recorded in time before the first ionization current $I_{neighborBk}$, in that $I_{C0}$ was recorded for example during a test run under laboratory conditions. Test runs under laboratory conditions typically take place as type tests and/or routine tests and/or as factory tests during the development or during the manufacturing of a device.

In accordance with a specific embodiment in this case each individual recorded value of the ionization current $I_{B0}$, if necessary $I_{B1}$ and if necessary $I_{C0}$, is a (weighted) average value of a number of measured values of the ionization current. In accordance with a particular embodiment the weighting involves an arithmetic or geometric mean. According to a further embodiment, during the weighting n inverse ionization currents $1/I_{B01}$, $1/I_{B02}$, $1/I_{B03}$ . . . $1/I_{B0n}$ are averaged to a mean ionization current $I_{B0}$ in accordance with $$\frac{n}{I_{B0}}=\frac{1}{I_{B01}}+\frac{1}{I_{B02}}+\frac{1}{I_{B03}}+\ldots+\frac{1}{I_{B0n}}$$

The ionization current $I_{Ck}$ thus established is now used as the basis for the corrected regulating curve. In the present case for example the ionization current is replaced at the obviously erroneous test point (18) by the ionization current $I_{Ck}$.

In other words the regulation device is additionally embodied to store the displaced third ionization current as part of a corrected regulating curve (17) and/or from this ionization current to compute and/or to store the correction (deviation) to the original regulating curve.

The burner system continues on the basis of the corrected regulating curve, until the burner system once again activates the power range or the air volume flow rate at test point (18), i.e. modulates in the area around test point (18). In this case an ionization current can be determined at the same test point, so that an actual measured value is present. The burner system then again uses a regulating curve based on measured values and not (only) on filtered estimated values. The modulation of the burner system in the area around the test point (18) can be undertaken both explicitly when the burner system is started and also during operation.

The present correction based on a filtering of the ionization current on preceding measured values is not used during the first hours of operation. Because of the peculiarity of a comparatively rapid ageing of the ionization electrode (2) during the first hours of days of operation a fitting during this period is suppressed. Preferably a fitting is suppressed for a period of around three days of operation. It is further preferred for a fitting to be suppressed during an initial operating time of one hour or of two hours or of five hours or of ten hours or of 20 hours or of one day or of two days or of 5 days or of 10 days or of 20 days. The suppression of the fitting produces combustion values deviating for the new state and as a rule somewhat leaner, which can be well tolerated however.

According to a further embodiment the correction based on a fitting is not suppressed during the first operating hours. Instead the comparatively rapid ageing of the ionization electrode (2) is taken into account in that test runs are first executed at shorter intervals. Through the use of test runs at shorter intervals the test points move less strongly between the test runs. Therefore, with test runs within shorter time intervals the said method of fitting the curve to ionization currents for preceding measured values can continue to be used.

According to a further embodiment the comparatively rapid change of the ionization electrode (2) is established by shorter intervals between test runs. In this case the system detects the change of ionization current between consecutive test runs and automatically shortens or lengthens the intervals between test runs. The shortening or lengthening of the intervals between consecutive test runs occurs in such cases as a function of the change in the ionization current (i.e. as a function of the gradient).

In other words, the regulation device is embodied, on the basis of the at least one ionization electrode (2), to repeatedly record ionization currents (15), and the regulation device is embodied to repeatedly form a difference between the reciprocal value of a first ionization current and a first air volume flow rate (16) and a reciprocal value of a second ionization current, which was recorded at a different time from the first ionization current and which belongs to the first air volume flow rate (16) or essentially belongs to the first air volume flow rate (16), wherein the intervals between differences being formed depend on the differences of the respective recorded ionization currents.

According to one embodiment, on the basis of the aforementioned steps and/or formulae, not only can ionization currents which belong to an aborted test run be displaced and/or fitted to curves. Instead any given values of ionization currents on a regulating curve can be estimated and/or filtered. This especially includes such values of ionization currents as have arisen through interpolation between measured values.

According to a further embodiment the correction of the regulating curve is carried out by the best fitting test point being selected during operation, starting from the current burner power. As a rule the best fitting test point is that test point which is closest to the current burner power of the current fan speed or the current air volume flow rate. An ionization current is then recorded at this test point. The ionization currents at the remaining test points are recorded subsequent to the ionization current for the best fitting test point. The ionization currents can for example only be recorded when the burner power or the fan speed or the air volume flow rate is modulating in the vicinity of the respective test point.

In other words, the regulation device is preferably embodied, during operation, starting from the current air volume flow rate 16 of the burner system, to select a best fitting test point of the regulating curve (14 or 17) and at this test point to record a pair consisting of ionization current 15 and air volume flow rate 16. The recording of pairs consisting of ionization current and air volume flow rate 16 at other test points of the regulating curve (14 or 17) is deferred.

Parts of a regulation device or of a method in accordance with the present disclosure can be realized as hardware, as a software module, which is executed by a processing unit, or on the basis of a cloud computer, or on the basis of a combination of the aforementioned options. The software may be firmware, a hardware driver, which is executed within the operating system, or an application program. The present disclosure thus also relates to a computer program product containing the features of this disclosure for executing the necessary steps. When realized as software the functions described can be stored as one or more commands on a computer-readable medium. A few examples of computer-readable media include random access memory (RAM), magnetic random access memory (MRAM), read-only memory (ROM), flash memory, electronically-programmable ROM (EPROM), electronically-programmable and erasable ROM (EEPROM), registers of a processor unit, a hard disk, a removable memory unit, an optical memory or any other suitable medium which can be accessed by a computer or by other IT facilities and applications.

The above description relates to individual forms of embodiment of the disclosure. Various modifications can be made to the forms of embodiment without deviating from the underlying idea and without departing from the framework of this disclosure. The subject matter of the present disclosure is defined via its claims. A wide variety of modifications can be made without departing from the scope of protection of the following claims.

LIST OF REFERENCE CHARACTERS

1 Flame
2 Ionization electrode
3 Flame amplifier
4 Ionization signal
5 Setting device
6 First actuator
7 Second actuator
8 First setting signal
9 Rpm signal
10 Second setting signal
11 Request signal
12 Air
13 Fuel
14 Regulating curve recorded in the laboratory under test conditions
15 Y-axis with ionization current
16 X-axis with fan speed or air volume flow rate or burner power/power of the burner system
17 Regulating curve, taking account of the ageing of the ionization electrode
18 Test point with aborted test run

What is claimed is:

1. A method for regulating a burner system with at least one burner, at least one memory, and at least one ionization electrode arranged to lie in an area of a flame of the at least one burner during operation of the burner, the method comprising:

recording an ionization current based on the at least one ionization electrode, setting an air volume flow rate of the burner system, based on the ionization current, storing, in the at least one memory, pairs consisting of air volume flow rate of the burner system and ionization current, forming a difference between a reciprocal value of a first ionization current for a first air volume flow rate and a reciprocal value of a second ionization current which was recorded prior to the first ionization current and associated with the first air volume flow rate, calculating a reciprocal value and a value of a displaced ionization current as the sum of the difference and a reciprocal value of a further ionization current, wherein the further ionization current and the displaced ionization current are associated with a second air volume flow rate of the burner system different from the first air volume flow rate of the burner system, filtering the reciprocal value or the value of the displaced ionization current using a filter constant on the reciprocal value or value of a historical ionization current which was recorded prior to the first ionization current and which is associated with the second air volume flow rate, such that a filtered ionization current and its reciprocal value are calculated as a result of the filtering, and calculating a second difference from a reciprocal value of the filtered ionization current and from a reciprocal value of the further ionization current.

2. A regulating device for regulating a burner system having at least one burner and at least one ionization electrode arranged to lie in an area of a flame of the at least one burner during operation of the burner system, wherein the regulation device is configured to:

record an ionization current based on the at least one ionization electrode, set an air volume flow rate of the burner system based on the ionization current, store, in a memory of the regulation device, pairs consisting of air volume flow rate of the burner system and ionization current, determine a difference between a reciprocal value of a first ionization current and a first air volume flow rate and a reciprocal value of a second ionization current which was recorded prior to the first ionization current and which is associated with the first air volume flow rate, calculate the reciprocal value and the value of a displaced ionization current as the sum of the determined difference and of the reciprocal value of a further ionization current, wherein the further ionization current and the displaced ionization current are associated with a second air volume flow rate of the burner system that is different from the first air volume flow rate of the burner system, and filter the reciprocal value or the value of the displaced ionization current using a filter constant on the reciprocal value or value of a historical ionization current which was recorded prior to the first ionization current and which is associated with the second air volume flow rate, such that a filtered ionization current and its reciprocal value are calculated as result of the filtering;

wherein the second ionization current was recorded under laboratory conditions at a new or little-aged ionization electrode.

3. A regulating device for regulating a burner system having at least one burner and at least one ionization electrode arranged to lie in an area of a flame of the at least one burner during operation of the burner system, wherein the regulation device is configured to:

record an ionization current based on the at least one ionization electrode, set an air volume flow rate of the burner system based on the ionization current, store, in a memory of the regulation device, pairs consisting of air volume flow rate of the burner system and ionization current, determine a difference between a reciprocal value of a first ionization current and a first air volume flow rate and a reciprocal value of a second ionization current which was recorded prior to the first ionization current and which is associated with the first air volume flow rate, calculate the reciprocal value and the value of a displaced ionization current as the sum of the determined difference and of the reciprocal value of a further ionization current, wherein the further ionization current and the displaced ionization current are associated with a second air volume flow rate of the burner system that is different from the first air volume flow rate of the burner system, and filter the reciprocal value or the value of the displaced ionization current using a filter constant on the reciprocal value or value of a historical ionization current which was recorded prior to the first ionization current and which is associated with the second air volume flow rate, such that a filtered ionization current and its reciprocal value are calculated as result of the filtering;

wherein the further ionization current was recorded under laboratory conditions at a new or little-aged ionization electrode.

4. The regulating device of claim 3, wherein the regulation device is additionally embodied to calculate a second difference from a reciprocal value of the filtered ionization current and from a reciprocal value of the further ionization current.

5. The regulating device of claim 4, wherein the regulation device is additionally embodied to add the second difference to the reciprocal value of a third ionization current and to obtain from said addition a displaced third ionization current, wherein the third ionization current was recorded at a point in time before first ionization current and belongs to the second air volume flow rate of the burner system.

6. The regulating device of claim 5, wherein the regulation device is additionally embodied, to join together pairs consisting of air volume flow rate of the burner system and ionization current into a regulating curve and to store them.

7. The regulating device of claim 6, wherein the regulation device is additionally embodied, to compute and/or to store the displaced third ionization current as part of a corrected regulating curve and/or to compute and/or to store from this ionization current, the correction, especially the deviation, from the original regulating curve.

8. The regulating device of claim 3, wherein the value or the reciprocal value of the displaced ionization current are filtered on the value or reciprocal value of a historical ionization current, in that the value or reciprocal value of the displaced ionization current are reduced by a percentage and the value or the reciprocal value of the historical ionization current are increased by the same percentage.

9. The regulating device of claim 3, wherein the regulation device is embodied to form a difference between the reciprocal value of a first ionization current for a first air volume flow rate and a reciprocal value of a second ionization current, which was recorded at a point in time before the first ionization current, and belongs to the first air volume flow rate or essentially belongs to the first air volume flow rate, and wherein the formation of the difference only occurs for the first time after an hour or after two hours or after five hours or after ten hours or after 20 hours or after one day or after two days or after 5 days or after 10 or after 20 days.

10. The regulating device of claim 3, wherein the regulation device is embodied, on the basis of the at least one ionization electrode, to repeatedly record ionization currents, and the regulation device is embodied to repeatedly form a difference between the reciprocal value of a first ionization current for a first air volume flow rate and a reciprocal value of a second ionization current which was recorded at a point in time before the first ionization current, and belongs to the first air volume flow rate or essentially belongs to the first air volume flow rate, and wherein the time intervals between the formation of the differences depend on the differences between the ionization currents recorded in each case.

11. The regulating device of claim 2, wherein the regulation device is additionally embodied to calculate a second difference from a reciprocal value of the filtered ionization current and from a reciprocal value of the further ionization current.

12. The regulating device of claim 11, wherein the regulation device is additionally embodied to add the second difference to the reciprocal value of a third ionization current and to obtain from said addition a displaced third ionization current, wherein the third ionization current was recorded at a point in time before first ionization current and belongs to the second aft volume flow rate of the burner system.

13. The regulating device of claim 12, wherein the regulation device is additionally embodied, to join together pairs consisting of aft volume flow rate of the burner system and ionization current into a regulating curve and to store them.

14. The regulating device of claim 13, wherein the regulation device is additionally embodied, to compute and/or to store the displaced third ionization current as part of a corrected regulating curve and/or to compute and/or to store from this ionization current, the correction, especially the deviation, from the original regulating curve.

15. The regulating device of claim 14, wherein the historical ionization current was recorded at a point in time after the second ionization current.

16. The regulating device of claim 2, wherein the value or the reciprocal value of the displaced ionization current are filtered on the value or reciprocal value of a historical ionization current, in that the value or reciprocal value of displaced ionization current are reduced by a percentage and the value or the reciprocal value of the historical ionization current are increased by the same percentage.

17. The regulating device of claim 2, wherein the regulation device is embodied, on the basis of at least one ionization electrode, to record an ionization current and the recording of the ionization current comprises a number of individual measurements of ionization currents.

18. The regulating device of claim 13, wherein regulation device is embodied, during operation, starting from the current air volume flow rate of the burner system, to select a best fitting test point of the regulating curve and to record at this test point a pair consisting of ionization current and aft volume low rate and to defer the recording of pairs consisting of ionization current and aft volume flow rate to other test points or the regulating curve.

19. The regulating device of claim 2, wherein the regulation device is embodied to form a difference between the reciprocal value of a first ionization current for a first aft volume flow rate and a reciprocal value of a second ionization current, which was recorded at a point in time before the first ionization current, and belongs to the first air volume flow rate or essentially belongs to the first air volume flow rate, and wherein the formation of the difference only occurs for the first time after an hour or after two hours or after five hours or after ten hours or after 20 hours or after one day or after two days or after 5 days or after 10 or after 20 days.

20. The regulating device of claim 2, wherein the regulation device is embodied, on the basis of the at least one ionization electrode, to repeatedly record ionization currents, and the regulation device is embodied to repeatedly forma difference between the reciprocal value of a first ionization current for a first air volume flow rate and a reciprocal value of a second ionization current which was recorded at a point in time before the first ionization current, and belongs to the first aft volume flow rate or essentially belongs to the first air volume flow rate, and wherein the time intervals between the formation of the differences depend on the differences between the ionization currents recorded in each case.

* * * * *